US011591201B2

(12) United States Patent
Welch et al.

(10) Patent No.: US 11,591,201 B2
(45) Date of Patent: Feb. 28, 2023

(54) BEVERAGE DISPENSING SYSTEMS WITH REMOTE MICRO-INGREDIENT STORAGE SYSTEMS

(71) Applicant: THE COCA-COLA COMPANY, Atlanta, GA (US)

(72) Inventors: Dick P. Welch, Marietta, GA (US); Brian R. Johnson, Roswell, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 17/431,595

(22) PCT Filed: Feb. 19, 2020

(86) PCT No.: PCT/US2020/018757

§ 371 (c)(1),
(2) Date: Aug. 17, 2021

(87) PCT Pub. No.: WO2020/172227

PCT Pub. Date: Aug. 27, 2020

(65) Prior Publication Data

US 2022/0112067 A1 Apr. 14, 2022

Related U.S. Application Data

(60) Provisional application No. 62/808,367, filed on Feb. 21, 2019.

(51) Int. Cl.
*B67D 1/00* (2006.01)

(52) U.S. Cl.
CPC ..... *B67D 1/0047* (2013.01); *B67D 1/0021* (2013.01); *B67D 2001/0091* (2013.01); *B67D 2210/0012* (2013.01)

(58) Field of Classification Search
CPC ..... B67D 1/0047; B67D 1/0021; B67D 2001/0091; B67D 2210/0012; B67D 1/0044; B67D 1/06
See application file for complete search history.

(56) References Cited

U.S. PATENT DOCUMENTS

2004/0074393 A1* 4/2004 Minard ..... B67D 1/1256 99/275
2011/0013474 A1 1/2011 Ludwig et al.
2012/0230148 A1 9/2012 Van Opstal et al.
2016/0100709 A1 4/2016 Rudick et al.

FOREIGN PATENT DOCUMENTS

WO 9015542 A1 12/1990
WO 2018140546 A1 8/2018

OTHER PUBLICATIONS

International Search Report and Written Opinion, PCT/US2020/018757, dated Jun. 15, 2020 (10 pp.).

* cited by examiner

*Primary Examiner* — Donnell A Long
(74) *Attorney, Agent, or Firm* — Eversheds Sutherland (US) LLP

(57) ABSTRACT

The present application thus provides a beverage dispensing system for combining a micro-ingredient and a diluent. The beverage dispensing system may include a nozzle and a remote micro-ingredient storage system positioned at a distance from the nozzle. The remote micro-ingredient storage system may include a stirring reservoir in communication with the nozzle to agitate the micro-ingredient therein.

13 Claims, 1 Drawing Sheet

BEVERAGE DISPENSING SYSTEMS WITH REMOTE MICRO-INGREDIENT STORAGE SYSTEMS

TECHNICAL FIELD

The present application and the resulting patent relate generally to beverage dispensing systems and more particularly relate to beverage dispensing systems with remote micro-ingredient storage systems using agitation in a stirring reservoir to prevent micro-ingredient separation.

BACKGROUND OF THE INVENTION

Conventional post-mix beverage dispensers generally mix streams of syrup, concentrate, sweetener, bonus flavors, other types of flavoring, and other ingredients with water or other types of diluents. Preferably, the beverage dispenser may provide as many types and flavors of beverages as may be possible in a footprint that may be as small as possible. Recent improvements in beverage dispensing technology have focused on the use of micro-ingredients. With micro-ingredients, the traditional beverage bases may be separated into a number of constituent parts at much higher dilution or reconstitution ratios. A beverage dispenser using micro-ingredients thus may provide the consumer with many more beverage options as compared to a conventional beverage dispenser using a limited number of beverage syrups.

Depending upon the intended location for the beverage dispenser and/or other considerations, some or all of the ingredients used in the beverage dispenser may be stored at a distance from the beverage dispenser and/or from the dispensing nozzle. For example, the sweetener may be stored in a conventional bag-in-box at a distance from the beverage dispenser. The flow of sweetener and/or other types of fluids may pass through a chiller that is remote from the beverage dispenser and/or the dispensing nozzle so as to keep the fluids chilled to the appropriate temperature.

Likewise with respect to micro-ingredients, such ingredients may be stored in or near the beverage dispenser. In certain locations, however, access to the beverage dispenser may be difficult or at least inconvenient in certain circumstances and/or during certain times of day. For example, in a busy drive through window or in a busy dining area, the restaurant operator may not want to stop the beverage dispenser from dispensing so as to replace the micro-ingredients therein. Storing the micro-ingredients at a remote location, however, may lead to product separation before the micro-ingredients reach the beverage dispenser.

SUMMARY OF THE INVENTION

The present application and the resultant patent thus provides a beverage dispensing system for combining a micro-ingredient and a diluent. The beverage dispensing system may include a nozzle and a remote micro-ingredient storage system positioned at a distance from the nozzle. The remote micro-ingredient storage system may include a stirring reservoir in communication with the nozzle to agitate the micro-ingredient therein.

The present application and the resultant patent further may describe a method of remotely dispensing a micro-ingredient to a nozzle. The method may include the steps of storing the micro-ingredient at a distance from the nozzle, operating a pump in a first direction to pump the micro-ingredient to a stirring reservoir, agitating the micro-ingredient in the stirring reservoir, and operating the pump in a second direction to pump the micro-ingredient to the nozzle.

The present application and the resultant patent further provides a beverage dispensing system for combining a micro-ingredient and a diluent. The beverage dispensing system may include a nozzle and a remote micro-ingredient storage system positioned at a distance from the nozzle. The remote micro-ingredient storage system may include a vented container in communication with the nozzle to degas the micro-ingredient therein.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
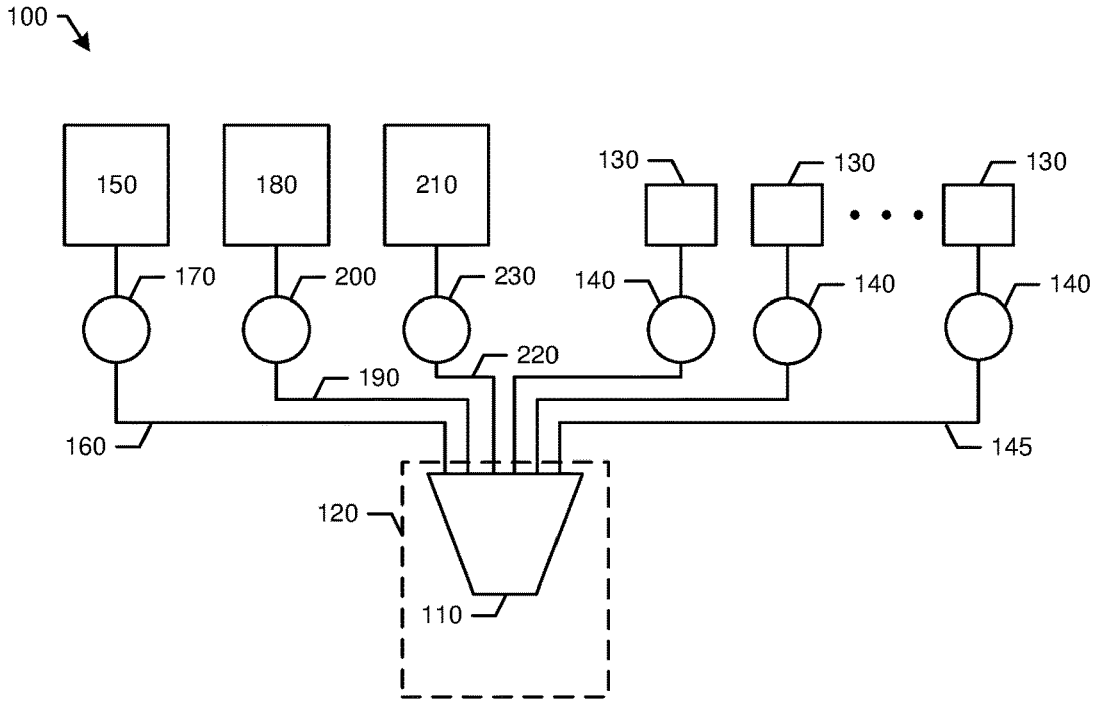
FIG. 1 is a schematic diagram of an example of a beverage dispensing system.

Referring now to the drawings, in which like numerals refer to like elements throughout the several views, FIG. 1 shows an example of a beverage dispensing system 100 as may be described herein. The beverage dispensing system 100 may be used for dispensing many different types of beverages or other types of fluids. Specifically, the beverage dispensing system 100 may be used with diluents, macro-ingredients, micro-ingredients, and other types of fluids. The diluents generally include plain water (still water or non-carbonated water), carbonated water, and other fluids. Any type of fluid may be used herein.

Generally described, the macro-ingredients may have reconstitution ratios in the range from full strength (no dilution) to about six (6) to one (1) (but generally less than about ten (10) to one (1)). The macro-ingredients may include sugar syrup, HFCS ("High Fructose Corn Syrup"), concentrated extracts, purees, and similar types of ingredients. Other ingredients may include dairy products, soy, and rice concentrates. Similarly, a macro-ingredient base product may include the sweetener as well as flavorings, acids, and other common components as a beverage syrup. The beverage syrup with sugar, HFCS, or other macro-ingredient base products generally may be stored in a conventional bag-in-box container remote from the beverage dispenser. The viscosity of the macro-ingredients may range from about 1 to about 10,000 centipoise and generally over 100 centipoises when chilled. Other types of macro-ingredients and the like may be used herein.

The micro-ingredients may have reconstitution ratios ranging from about ten (10) to one (1) and higher. Specifically, many micro-ingredients may have reconstitution ratios in the range of about 20:1, to 50:1, to 100:1, to 300:1, or higher. The viscosities of the micro-ingredients typically range from about one (1) to about six (6) centipoise or so, but may vary from this range. Examples of micro-ingredients include natural or artificial flavors; flavor additives; natural or artificial colors; artificial sweeteners (high potency, nonnutritive, or otherwise); antifoam agents, nonnutritive ingredients, additives for controlling tartness, e.g., citric acid or potassium citrate; functional additives such as vitamins, minerals, herbal extracts, nutraceuticals; and over the counter (or otherwise) medicines such as turmeric, acetaminophen; and similar types of ingredients. Various types of alcohols may be used as either macro- or micro-ingredients. The micro-ingredients may be in liquid, gaseous, or powder form (and/or combinations thereof including soluble and suspended ingredients in a variety of media, including water, organic solvents, and oils). Other types of micro-ingredients may be used herein.

The various fluids used herein may be mixed in or about a dispensing nozzle 110. The dispensing nozzle 110 may be a conventional multi-flavor nozzle and the like. The dispensing nozzle 110 may have any suitable size, shape, or configuration. The dispensing nozzle 110 may be positioned within a dispensing tower 120. The dispensing tower 120 made have any suitable size, shape, or configuration. The dispensing tower 120 may extend from a countertop and the like and/or the dispensing tower 120 may be a free-standing structure. The dispensing tower 120 may have a number of the dispensing nozzles 110 thereon.

The micro-ingredients may be stored in a number of micro-ingredient containers 130 or other types of micro-ingredient sources. The micro-ingredient containers 130 may have any suitable size, shape, or configuration. Any number of the micro-ingredient containers 130 may be used herein. The micro-ingredient containers 130 may be in communication with the dispensing nozzle 110 via a number of micro-ingredient pumps 140 positioned on a number of micro-ingredient conduits 145. The micro-ingredient pumps 140 may be any type of conventional fluid moving device and made have any suitable volume or capacity. The micro-ingredient containers 130 may be positioned in, adjacent to, and/or remote from the dispensing nozzle 110. For example, the micro-ingredient containers 130 may be positioned under the counter top upon which the dispensing tower 120 rests. Some or all of the micro-ingredient containers 130 may be agitated.

A still water source 150 may be in communication with the dispensing nozzle 110 via a still water conduit 160. Other types of diluents may be used herein. Still water or other types of diluents may be pumped to the dispensing nozzle 110 via a still water pump 170. The still water pump 170 may be may be any type of conventional fluid moving device and made have any suitable volume or capacity. Alternatively, the pressure in a conventional municipal water source may be sufficient without the use of a pump. Any number of still water sources 150 may be used herein.

A carbonated water source 180 may be in communication with the dispensing nozzle 110 via a carbonated water conduit 190. The carbonated water source 180 may be a conventional carbonator and the like. The carbonator may have any suitable size, shape, or configuration. Carbonated water or other types of diluents may be pumped to the dispensing nozzle 110 via a carbonated water pump 200. The carbonated water pump 200 may be any type of conventional fluid moving device and made have any suitable volume or capacity. Any number of carbonated water sources 180 may be used herein. A carbonated water recirculation line also may be used herein.

One or more macro-ingredient sources 210 may be in communication with the dispensing nozzle 110 via one or more macro-ingredient conduits 220. The macro-ingredient sources 210 may include sweeteners such as high fructose corn syrup, sugar solutions, and the like. The macro-ingredient sources 210 may be a conventional bag-in-box or other type of container in any suitable size, shape, or configuration. Any number of the macro-ingredient sources 210 may be used herein. The macro-ingredients may flow to the dispensing nozzle 110 via a macro-ingredient pump 230. In this case, the macro-ingredient pump 230 may be a controlled gear pump and the like. Other types of pumps may be used herein.

Figure 2:
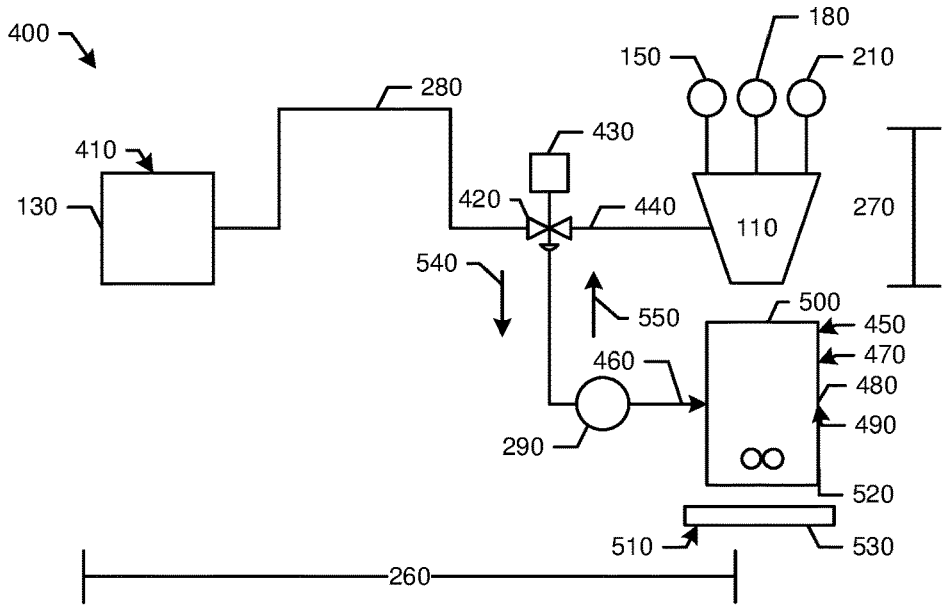
FIG. 2 is a schematic diagram of a remote micro-ingredient storage system as may be described herein for use with the beverage dispensing system of FIG. 1 and similar systems.

FIG. 2 shows a further example of a beverage dispensing system 400 as may be described herein. As described above, there may be certain circumstances where it may be advantageous to store the micro-ingredients at a distance from the dispensing tower 120. This distance may include a horizontal distance 260 and/or a vertical distance 270. The horizontal distance 260 may be about fifty feet (15.24 meters), seventy-five feet (22.86 meters), one hundred feet (30.48 meters), or more. The vertical distance 270 may be about five feet (1.52 meters), ten feet (3.048 meters), or more. The distances from the dispensing tower 120 may vary.

In this example, the beverage dispensing system 400 also may include a remote micro-ingredient storage system 410 with any number of the micro-ingredient containers 130 positioned remotely from the beverage tower 120 at the horizontal distance 260. The micro-ingredient containers 130 may be connected to the dispensing nozzle 110 of the dispensing tower 120 via a length of flexible tubing 280 or other type of conduit made of food grade thermoplastics and the like. A length of fixed tubing 280 also may be used. The length and the diameter of the tubing 280 may vary.

The remote micro-ingredient storage system 410 may include one or more micro-ingredient pumps 290. The micro-ingredient pumps 290 may include a conventional metered pump, a positive displacement pump, a metering pump, a syringe pump, a rotary pump, a peristaltic pump, a nutating pump, a gear pump, and/or other types of fluid moving devices. Any type of pumping device capable of accurately dosing the micro-ingredients may be used herein. The micro-ingredient pump 290 also may include a variable speed motor so as to generate a variable fluid flow. In this example, the micro-ingredient pump 290 also may be reversible for driving the flow of micro-ingredient in either the forward or the reverse direction. Other component and other configurations also may be used herein.

The tubing 280 may be attached to the micro-ingredient container 130 on a first end thereof. The remote micro-ingredient storage system 410 may include a dispensing three way valve 420 positioned on the tubing 280 at a second end thereof. The dispensing three way valve 420 may be of conventional design. The dispensing three way valve 420 may be operated by a dispensing actuator 430 or through passive means. The dispensing actuator 430 may be of conventional design. The dispensing three way valve 420 may be connected to the dispensing nozzle 110 via a nozzle connector 440 and to an agitation device 450 via an agitation connector 460. The micro-ingredient pump 290 may be positioned on either the nozzle connector 440 or the agitation connector 460. Other components and other configurations may be used herein.

In this example, the agitation device 450 may be in the form of a stirring reservoir 470. The stirring reservoir 470 may be position in or adjacent to the beverage 120. The stirring reservoir 470 may include a vented container 480 with a stirring device 490 therein. The vented container 480 may have any suitable size, shape, or configuration. The vented container 480 may be sized in a manner similar to the micro-ingredient containers 130. The vented container 480 may have an air vent 500 thereon so as to vent any air bubbles in the flow of micro-ingredient in the tubing 280. The stirring device 490 may be, for example, a magnetic stirrer 510. The magnetic stirrer 510 may include a propeller 520 positioned within the vented container 480 and a magnetic base 530 positioned underneath the vented container 480. Activation of the magnetic base 530 causes the propeller 520 to rotate within the vented container 480 so to agitate the micro-ingredient therein. Other types of agitation devices 450 may be used herein. Other components and other configurations may be used herein.

Other types of reservoirs also may be used herein. For example, not all micro-ingredients require agitation. Given such, the vented container 480 without a magnetic stirrer 510 or other type of agitation device and/or without the magnetic stirrer 510 being activated also may be used herein so as to store and degas the micro-ingredient therein.

In use, the dispensing three way valve 420 may be open to the agitation connector 460 and the stirring reservoir 470 or other type of agitation device 450 by the dispensing actuator 430 while the nozzle connector 440 to the dispensing nozzle 110 may be closed. The micro-ingredient pump 290 then may fill the stirring reservoir 470 with the micro-ingredient while operating in a forward or a first direction 540. Once the stirring reservoir 470 is full, the stirring device 490 may spin so as to agitate the micro-ingredient on a periodic or continuous basis. The stirring device 490 may create turbulence in the vented container 480 so as to promote good mixing and, hence, reducing or avoiding product separation therein.

When a beverage is to be dispensed, the dispensing actuator 430 may open the dispensing three way valve 420 to the dispensing nozzle 110 and close the tubing 280 to the micro-ingredient container 130. The micro-ingredient pump 290 may meter the correct volume of micro-ingredient to the dispensing nozzle 110 when acting in the reverse or a second direction 550. The dispensing actuator 430 then may open the dispensing three way valve 420 to the micro-ingredient container 130 so as to replenish the micro-ingredient volume in the vented container 480. Other components and other configurations may be used herein.

It should be apparent that the foregoing relates only to certain embodiments of the present application and the resulting patent. Numerous changes and modifications may be made herein by one of ordinary skill in the art without departing from the general spirit and scope of the invention as defined by the following claims and the equivalents thereof.

We claim:

1. A beverage dispensing system for combining a micro-ingredient and a diluent, comprising:

a nozzle; and a remote micro-ingredient storage system with a micro-ingredient container positioned at a distance from the nozzle;

wherein the remote micro-ingredient storage system comprises a stirring reservoir in communication with the nozzle to agitate the micro-ingredient therein; and wherein the remote micro-ingredient storage system comprising a three way dispensing valve in communication with the nozzle, the stirring reservoir, and the micro-ingredient container.

2. The beverage dispensing system of claim 1, wherein the stirring reservoir comprises a vented container.

3. The beverage dispensing system of claim 1, wherein the stirring reservoir comprises a magnetic stirrer.

4. The beverage dispensing system of claim 3, wherein the magnetic stirrer comprises a propeller and a magnetic base.

5. The beverage dispensing system of claim 1, wherein the distance comprises a horizontal distance of more than about 100 feet (30.48 meters).

6. The beverage dispensing system of claim 1, wherein the distance comprises a vertical distance of more than about 10 feet (3.048 meters).

7. The beverage dispensing system of claim 1, wherein the remote micro-ingredient storage system comprises an actuator in communication with the dispensing valve.

8. The beverage dispensing system of claim 1, wherein the remote micro-ingredient storage system comprises a nozzle connector connecting the dispensing valve and the nozzle.

9. The beverage dispensing system of claim 1, wherein the remote micro-ingredient storage system comprises an agitation connector in communication with the dispensing valve and the stirring reservoir.

10. The beverage dispensing system of claim 1, wherein the remote micro-ingredient storage system comprises a pump in communication with the nozzle, the stirring reservoir, and the micro-ingredient container.

11. The beverage dispensing system of claim 10, wherein the pump pumps the micro-ingredient from the micro-ingredient container to the stirring reservoir when operating in a first direction.

12. The beverage dispensing system of claim 11, wherein the pump pumps the micro-ingredient from the stirring reservoir to the nozzle when operating in a second direction.

13. A method of remotely dispensing a micro-ingredient to a nozzle, comprising:

storing the micro-ingredient at a distance from the nozzle;

opening a dispensing valve in a first orientation;

operating a pump in a first direction to pump the micro-ingredient through the dispensing valve to a stirring reservoir;

agitating the micro-ingredient in the stirring reservoir;

opening the dispensing valve in a second orientation; and operating the pump in a second direction to pump the micro-ingredient through the dispensing valve to the nozzle.

* * * * *